US005285128A

United States Patent [19]

Hórvath et al.

[11] Patent Number: 5,285,128

[45] Date of Patent: Feb. 8, 1994

[54] LOW-PRESSURE DISCHARGE LAMP

[75] Inventors: Györgyi Hórvath; Tamás Palotai; József Fülöp; Miklós Hargitai, all of Budapest, Hungary

[73] Assignee: Tungsram Részvénytársaság, Budapest, Hungary

[21] Appl. No.: 827,396

[22] Filed: Jan. 29, 1992

[30] Foreign Application Priority Data

Jan. 29, 1991 [HU] Hungary ..... 297/91

[51] Int. Cl.[5] ..... H01J 61/36

[52] U.S. Cl. ..... 313/318; 313/623

[58] Field of Search ..... 313/623, 624, 331, 332, 313/318

[56] References Cited

U.S. PATENT DOCUMENTS

| | | | |
|---|---|---|---|
| 3,868,528 | 2/1975 | Lake et al. | 313/332 X |
| 4,324,998 | 4/1982 | Gilmore et al. | 313/623 X |
| 4,928,032 | 5/1990 | Skoch et al. | 313/318 |

*Primary Examiner*—Sandra L. O'Shea

*Attorney, Agent, or Firm*—Spencer, Frank & Schneider

[57] ABSTRACT

The present invention relates to low-pressure discharge lamp having a discharge tube filled with mercury and a noble gas, sealed in a gas-tight manner and provided with electrodes at its ends and having a cap connected to the discharge tube and contact components for connection to a power supply, the discharge tube ends containing the electrodes are arranged adjacent to each other, the electrode-side ends of the discharge tube are fixed—e.g. by means of an adhesive—in the cap, at least a portion of the electrode leads is fixed in the holes of the connecting part of the cap and is connected to conduct electric current, with at least a part of the contact components protruding from the outer side of the connecting part. According to the invention the contact components (1) are completed with connecting extensions (1*a*) located in the inner space (2*a*) of the cap (2), at least a part of the leads (4*a*) is fixed to the connecting extensions (1*a*) of the contact components (1) and the joint (5) between the leads (4*a*) and the connecting extensions (1*a*) is also arranged in the inner space (2*a*) of the cap (2).

8 Claims, 2 Drawing Sheets

LOW-PRESSURE DISCHARGE LAMP

BACKGROUND OF THE INVENTION

The present invention relates to a low-pressure discharge lamp having a discharge tube filled with mercury and a noble gas, sealed in a gas-tight manner and provided with electrodes at its ends and having a cap connected to the discharge tube and contact components for connection to a power supply, the discharge tube ends containing the electrodes are arranged adjacent to each other, the electrode-side ends of the discharge tube are fixed—e.g. by means of an adhesive—in the cap, at least a portion of the electrode leads is fixed in the holes of the connecting part of the cap and is connected to conduct electric current, with at least a part of the contact components protruding from the outer side of the connecting part.

The fact that the so-called compact fluorescent lamps are becoming more and more widespread recently is explained by their low specific energy consumption and long life. Nowadays, these low-pressure mercury discharge lamp types are used not only indoors, but their application is continuously gaining ground, e.g. in the advertisement and decorative lighting also—another field where the energy consumed for ensuring the desired lighting effect is an important aspect.

Lamp manufacturers are making efforts to produce fluorescent lamps with continuously increased life and reliability, in the best possible quality and economically.

Several solutions are known for improving the compact fluorescent lamp properties and reducing manufacturing costs. The cap design in the construction of a low-pressure mercury discharge lamp provided with improved cap according to Hungarian Patent No. 196.860 simplifies the insertion of a starter and the connection of current leads connected to the starter. The cylindrical contact components for connection to the lamp-holder are joined with the current leads by means of mechanical fixation as usual in conventional fluorescent lamps. This is performed by pressing a portion of the mantle surface of the contact component from two directions on the current lead inserted into the cylindrical cavity contact component previously mounted in the cap.

The joint produced in this way has several disadvantages. The major one of these is that the joint produced by deforming the corresponding parts is of unsafe quality strongly depending on the physical characteristics of the partner materials of the joint.

A further disadvantage is that the quality of the joint cannot be directly inspected. Due to this, rejects can be separated only in extreme cases when the lamp does not start as early as during manufacturing and joints with intolerable performance from the lamp quality point of view are left in the manufacturing process. Intolerable performance means that, caused by the poor contact between contact component and current lead, the contact resistance in the joint spot may have a wide-range spread adversely affecting electric lamp parameters and quality.

As the shape and dimensions of the lamp parts including the contact component that have to match the lamp-holder are specified by standards, a close control of the location and dimensions of the joint is needed and this increases lamp production expenses.

SUMMARY OF THE INVENTION

The object of the present invention is therefore to eliminate the above mentioned disadvantages as well as to make a discharge lamp in which the joint between the contact component and current lead is characterized by reliable quality and low contact resistance. Another object is to ensure the possibility for assessing the quality of joint prior to the final assembling of the discharge lamp.

The invention is based on the recognition that a joint with minimum contact resistance can be achieved if contact components provided with unique connection surfaces and fundamentally differing from the known solutions are used, the joint between the contact components and connecting current leads is performed prior to fixing the contact components to the cap, and the joint is located in the inner space of the discharge lamp cap.

Accordingly, the low-pressure discharge lamp according to the invention—having a discharge tube filled with mercury and a noble gas, sealed in a gas-tight manner and provided with electrodes at its ends and having a cap connected to the discharge tube and contact components for connection to a power supply, the discharge tube ends containing the elctrodes are arranged adjacent to each other, the electrode-side ends of the discharge tube are fixed—e.g. means of an adhesive—in the cap, at least a portion of the electrode leads is fixed in the holes of the connecting part of the cap and is connected to conduct electric current, with at least a part of the contact components protruding from the outer side of the connecting part—is made in the way that the contact components are completed with connecting extensions located in the inner space of the cap, at least a part of the leads is fixed to the connecting extensions of the contact components and the joint between the leads and the connecting extensions is also arranged in the inner space of the cap.

A further possible feature of the discharge lamp according to the invention is that the current leads and the connecting extensions are fixed to each other by means of adhesion or cohesion bond or the joint is performed using deformation, e.g. by pressing. In a preferred embodiment, the contact components are provided with recesses, the bores of the connecting part of the cap have shoulder portions protruding into the bores and matching to the shape of the recesses of the contact components are fixed in the bores by the shoulder portions matching to the recesses.

In another possible embodiment, the inner side of the connecting part of the cap is provided with supporting profiles adjacent to the bores for passing the contact components.

It is a preferred embodiment for outdoor applications in which the surface of the joint is provided with an insulating coating.

The discharge lamp according to the invention has the advantage that, by shaping the connecting extension of the contact component appropriately, a large-surface joint can be achieved resulting in the increase of the surface available for current conduction between the two parts and reducing the electric load of the joint. This further improves the life and reliability of the discharge lamp.

The low-pressure discharge lamp according to the invention has a further advantage of having a minimum contact resistance at the joint of the current lead making the lamp suitable even for the most demanding modes of operation such as the high-frequency supply. Also, the opportunity is given for inspecting the value of contact resistance between the contact component and the current lead in a simple manner. Due to this, the quality of discharge lamps will significantly improve combined with an increase in life. With respect to the mass-production, it is an important aspect that any technology—e.g. adhesion or cohesion bond—can be used for producing the joint in the inner space of the cap. This design also decreases the possibility for the corrosion of the joint and enables to choose partner materials favorable for making the joint, e.g. identical materials can be used in the case of welding.

An economy benefit is offered by the feature that smaller loss from reject occurs during the manufacture of the discharge lamp according to the invention as the discharge lamps having unsatisfactory joints can be separated and reworked in course of the manufacturing process. In addition, no requirements exist for the appearance of the joint in the inner space of the cap and even its dimensions are not restricted by standards as the joint is located at that end of the contact component which is not inserted into the lamp-holder.

DESCRIPTION OF THE PREFERRED EMBODIMENTS

Figure 1:
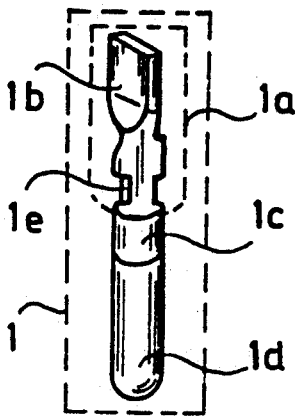
FIG. 1 is a view of the contact component in a preferred embodiment
Figure 2:
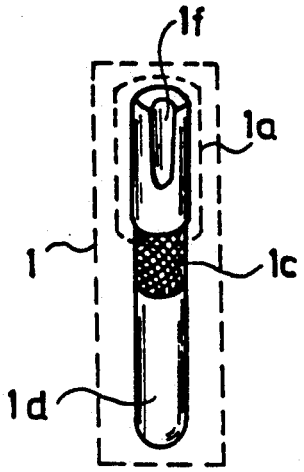
FIG. 2 is a view of the contact compoent in another preferred embodiment.
Figure 3:
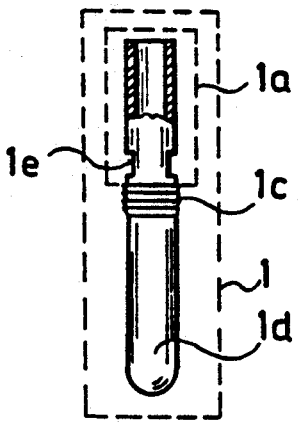
FIG. 3 is a side elevation view, partly in section, of the contact component in a further preferred embodiment.

In FIGS. 1 to 3, different embodiments of the contact components 1 are shown.

FIG. 1 illustrates a contact component or contact pin 1 with the connecting extension 1*a* which ends in a flattened portion 1*b*.

Recesses 1*e* are milled grooves in the contact component 1 and serve for positioning the contact component 1.

Figure 4:
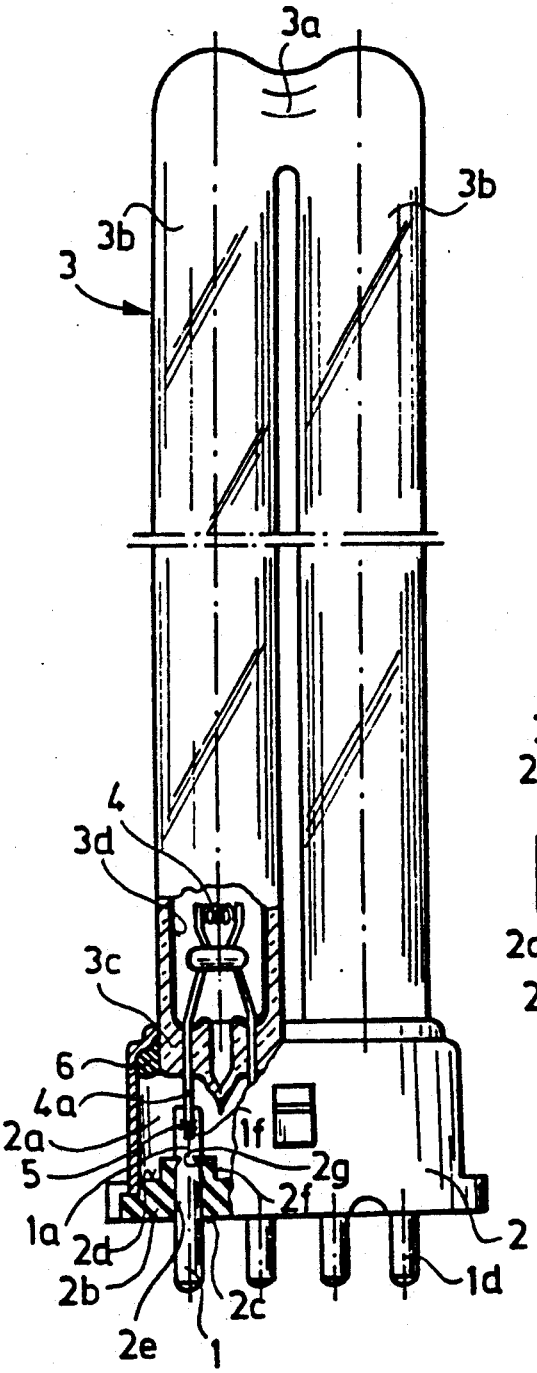
FIG. 4 is a side elevation view, partly in section, of an embodiment of the low-pressure discharge lamp according to the invention

Outer side 1*d* of the contact component is suitable for inserting discharge lamp 3 (FIG. 4) into the lamp-holder. Fixing surface 1*c* of the contact component 1 is made to enable fit in bore 2*e* of cap 2 (FIG. 4).

In FIG. 2, a slot 1*f* is made in the connecting extension 1*a* of the contact component 1. The fixing surface 1*c* is knurled making the recesses 1*e* shown in FIG. 1 unnecessary.

The material of the contact component 1 is a nickel-iron alloy, but it can be made from any other material usual in the manufacture of contact components 1.

In FIG. 3, the initial form of the contact component 1 is different from that of the earlier ones. These latter ones are suitably solid cylindrical wires, while the former one is preferably a brass tube. In this embodiment, the fixing surface 1*c* is provided with a circular groove. The tube from which the contact component 1 is made may have any inside diameter.

It is seen from FIGS. 1 to 3 that the shaping of the contact components 1 is very diverse and, of course, not only the contact components 1 with those shapings shown in the Figures are suitable for the low-pressure discharge lamp according to the invention. The connecting extension 1*a* is shaped to enable different types of joint between the contact component 1 and the current lead 4*a* (FIG. 4). This includes that, according to FIG. 2, it is practical to fix the current lead 4*a* in the slot 1*f* of the connecting extension 1*a* of the contact component 1 by means of adhesion bond, e.g. soldering or cohesion bond, e.g. welding. The connecting extension 1*a* of the contact component 1 shown in FIG. 3 is shaped to be also suitable for making the joint by means of an adhesive material or by pressing.

In FIG. 4, a low-pressure disscharge lamp is shown which has a discharge tube 3 consisting of straight portions 3*b* parallel to each other and a bridging portion 3*a* connecting them in a way that permits the discharge to pass. In the two adjacent end portions 3*c* of the discharge tube 3, electrodes 4 are located. One of the electrodes 4 may be seen in the cut out portion of the discharge tube 3 shown in FIG. 4.

A coating of phosphor layer 3*d* is on the inner wall of the discharge tube 3 to convert the ultraviolet radiation from the mercury additive excited in the argon fill gas of the discharge tube 3 into visible light.

The discharge tube 3 is fixed to the cap 2 by an adhesive 6, e.g. a capping cement. The current leads 4*a* are connected to the contact component 1 by a welded joint 5. The joint 5 between the slot 1*f* the connecting extension 1*a* of the contact component 1 and the current lead 4*a* is preferably a spot-welded joint 5. The joint 5 is located in the inner space 2*a* of the cap 2. It is also clearly seen how the contact component 1 is fixed in the cap 2.

Supporting profile 2*f* is preferably a tubular protrusion and is located on the inner side 2*d* of the connecting part or base 2*b* of the cap 2. The supporting profile or raised portion 2*f* has, at its end closer to the inner space 2*a* of the cap 2, a shoulder portion 2*g* for facilitating the positioning of the contact component 1.

The contact components 1 are inserted into bores 2*e* of the cap 2 and the recesses 1*e* on the mantle surface of the contact component 1 keep them in position. The shoulder portion 2*g* engaging in recesses 1*e* prevents the outer portion 1*d* of the contact component 1 from slipping back. In this way, the outer portions 1*d* of all the contact components 1 protrude to an equal extent on the outer side 2*e* of the conecting part 2*b*. It is practical to make the joint 5 between the current lead 4*a* and the contact component 1 prior to fixing the cap 2. This is favorable also in the respect of making sure of the performance of the joint 5 immediately after it was made. In the case when the joint 5 has a satisfactory current conductivity, i.e. low contact resistance, the discharge tube 3 may be fixed in the cap 2 using an adhesive material 6. This is followed by pushing the contact components through the bores 2*e* of the connecting part 2*b* until stopped by the shoulder portion 2*g* of the supporting profile 2*f*. The supporting profile 2*f* protruding from the inner side 2*d* of the connecting part 2*b* serves to fix the contact component 1 on a larger surface, but it does not form an indispensable part of the solution according to the invention.

The outer portion 1*d* of the contact component 1 can be pushed through the connecting part 2*b*, then gripped on the outer side 2*c* and pulled until stop. This brings the contact component 1 to its final position in which the shoulder portion 2*g* of the supporting profile 2*f* of the connecting part 2b is firmly fixed in the recesses 1e of the contact component 1. After fixing the contact components 1, the connecting part 2b and the cap 2 can be joined. If the connecting part 2b and the cap 2 are made from plastic, a self-locking connection can be obtained by suitably shaping the two components.

Figure 5:
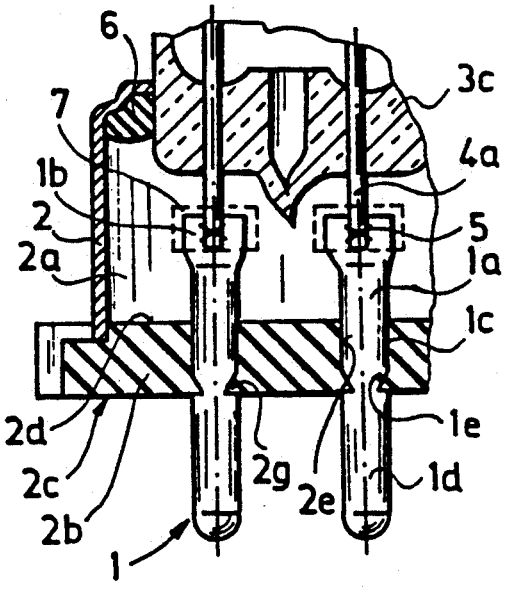
FIG. 5 is a detail of cap design of the low-pressure discharge lamp according to the invention.

In FIG. 5, another possibility is shown for joining the contact component 1 and the connecting part 2b of the cap 2.

The inner side 2d of the connecting part 2b has no supporting profile 2f present in the FIG. 4—embodiment. The shoulder portion 2g engaging in the recessess 1e of the contact component 1 is located at that end of the bore which is closer to the outer side 2c of the connecting part 2b.

The connecting extension 1a of the contact component protruding into the inner space 2a of the cap 2 has a flattened portion 1b at its end and the current lead 4a is connected to this flattened portion lb by means of a welded joint 5.

In order to enhance its resistance to corrosion the surface and the environment of the joint 5 is provided with an insulating coating 7 that can be applied to the surface by spraying or painting or any other conventional technique.

The low-pressures discharge lamp can be successfully used both for indoor and outdoor lighting in applications aimed at the achievement of good illumination using long-life and reliable light sources with low energy consumption.

Its use is particularly favorable in fields using an electronic mode of operation.

We claim:

1. A discharge lamp comprising (a) a gas-filled, sealed discharge tube having an end;

(b) an electrode disposed in said discharge tube and having an electrode lead passing through said end and terminating exteriorly of said discharge tube;

(c) a cap affixed to said discharge tube about said end; said cap including a base having an opening; said base being spaced from said end; said cap defining an inner space bounded by said end;

(d) a contact component including (1) a first portion accommodated and held in said base;

(2) a second portion accessible externally of said discharge tube and said cap for connection to a power supply; and (3) a connecting extension projecting from said base into said inner space; and (e) a joint binding said electrode lead to said connecting extension; said joint being located in said inner space at a distance from said base.

2. The discharge lamp as defined in claim 1, wherein said electrode lead and said connecting extension are joined by adhesion.

3. The discharge lamp as defined in claim 1, wherein said electrode lead and said connecting extension are joined by cohesion.

4. The discharge lamp as defined in claim 1, wherein said electrode lead and said connecting extension are joined by deformation.

5. The discharge lamp as defined in claim 1, further comprising a recess provided in said first portion of said contact component and a shoulder forming part of said base and projecting into said opening; said shoulder complementally fitting into said recess; said contact component being held in said opening of said base by an interengagement between said shoulder and said recess.

6. The discharge lamp as defined in claim 1, wherein said base has a raised portion projecting into said inner space; said opening passing through and being surrounded by said raised portion for engaging and supporting said contact component.

7. The discharge lamp as defined in claim 1, wherein said joint is covered by an insulating coating.

8. The discharge lamp as defined in claim 1, wherein said contact component is a contact pin thereof.

* * * * *